US005082531A

United States Patent [19]

Takeuchi

[11] Patent Number: 5,082,531

[45] Date of Patent: Jan. 21, 1992

[54] HEAD BOX IN A PAPER MACHINE

[75] Inventor: Hiroshi Takeuchi, Fuji, Japan

[73] Assignees: Hasegawa Machinery Limited; Hiroshi Takeuchi, both of Shizuoka, Japan

[21] Appl. No.: 603,024

[22] Filed: Oct. 26, 1990

[51] Int. Cl.[5] ..... D21F 1/02

[52] U.S. Cl. ..... 162/343; 162/336

[58] Field of Search ..... 162/336, 343, 344

[56] References Cited

U.S. PATENT DOCUMENTS

| | | | |
|---|---|---|---|
| 3,272,233 | 9/1966 | Truffitt | 162/343 |
| 3,528,882 | 9/1970 | Nothohm | 162/343 |
| 3,607,625 | 9/1971 | Hill et al. | 162/343 |
| 4,146,427 | 3/1979 | Hogel et al. | 162/343 |

*Primary Examiner*—Karen M. Hastings

*Attorney, Agent, or Firm*—Wenderoth, Lind & Ponack

[57] ABSTRACT

A head box in a paper machine, has a group of conduction pipes for guiding paper material from a mixing chamber into a slice. The pipes are fixed to a frame at one end of the head box on the side of the slice lip. Long portions of the group of conduction pipes, ending at end portions on the side of the mixing chamber, are not fixed to the frame. A perforated plate disposed at an outlet port side of the mixing chamber is also not fixed to the frame, and is connected to the group of conduction pipes. The group of conduction pipes thus freely expand and contract at their non-fixed ends on the side of the perforated plate. The perforated plate is integrally moved following thermal expansion and contraction of the group of conduction pipes, thereby absorbing the thermal expansion and contraction.

4 Claims, 2 Drawing Sheets

HEAD BOX IN A PAPER MACHINE

BACKGROUND OF THE INVENTION

1. Field of the Invention

This invention relates to a head box in a paper machine, and particularly to a head box in a paper machine in which a perforated plate and a conduction pipe group for dispersing and straightening paper material are disposed between a mixing chamber at a rear end of the head box and a slice lip at a front end of the head box.

2. Brief Description of the Prior Art

A head box has at a rear end thereof a mixing chamber which normally receives a supply of paper material and at a front end thereof a slice lip for flowing paper material onto a paper forming belt. It also has means for dispersing paper material and straightening the material between the slice lip and the mixing chamber. Heretofore, there is known a head box in which, as, a means for dispersing the paper material and straightening thereof, a perforated plate is disposed on the outlet side of the mixing chamber and a group of elongated metal conduction pipes are disposed over generally the entire distance between the perforated plate and the slice lip.

Paper material supplied to the mixing chamber and passed through the perforated plate is further passed through the group of elongated conduction pipes, where the paper material is enhanced to be uniformly dispersed and straightened and given directivity, and then discharged into the slice lip.

The group of conduction pipes and the perforated plate are assembled in the head box in the afore-mentioned arrangement and firmly fixed to a frame for accommodating them.

The group of conduction pipes are expanded and contracted depending on the temperature of the paper material flowing in the conduction pipes, the temperature difference caused by environmental circumstances, etc. Heretofore, however, the group of conduction pipes and the perforated plate are fixed to the frame of the head box and thus unable to be expanded and contracted.

As a consequence, the group of conduction pipes are distorted and deformed due to the thermal expansion and contraction phenomenon, and for this reason, accuracy of the conduction pipes is jeopardized. As a result, the dispersing and straightening functions of the respective conduction pipes are impared, or the stream or flow is not uniform, thereby giving an unfavorable effect to the texture of paper, etc.

SUMMARY OF THE INVENTION

It is therefore a general object of the present invention to provide a head box in a paper machine which is capable of effectively solving the above-mentioned problems.

In order to solve the problems, a head box in a paper machine according to the present invention is constructed such that the group of conduction pipes for guiding paper material in the mixing chamber into a slice lip is fixed to a frame at one end portion on the side of the slice lip, and long portions of the group of conduction pipes, ending at the end portions on the side of the mixing chamber, are not fixed to the frame, a perforated plate is disposed at an outlet port side of the mixing chamber and also not fixed to the frame, but is connected to the group of conduction pipes. The group of conduction pipes then freely expand and contract at their non-fixed ends on the side of the perforated plate, the perforated plate being integrally moved following thermal expansion and contraction of the group of conduction pipes and thereby absorbing the thermal expansion and contraction.

According to the present invention, the group of conduction pipes are freely expanded and contracted by heat on the side of its non-fixed ends due to the temperature of the paper material, temperature differences caused by environmental circumstances, etc., and the perforated plate is also moved following this to absorb the thermal expansion and contraction. Accordingly, disturbance factors such as distortion, deformation, etc. caused by the thermal expansion and contraction phenomenon of the group of conduction pipes can be surely removed, uniformed flow of the paper material fed to the slice lip can be ensured by maintaining the accuracy of the group of conduction pipes, and the dispersion and straightening function can be properly performed.

The above and other objects, features and advantages of the present invention will become more apparent, and the invention itself will best be understood, from a study of the following description and appended claims, with reference had to the attached drawings showing one preferred embodiment of the invention.

DETAILED DESCRIPTION OF THE EMBODIMENT

Figure 1:
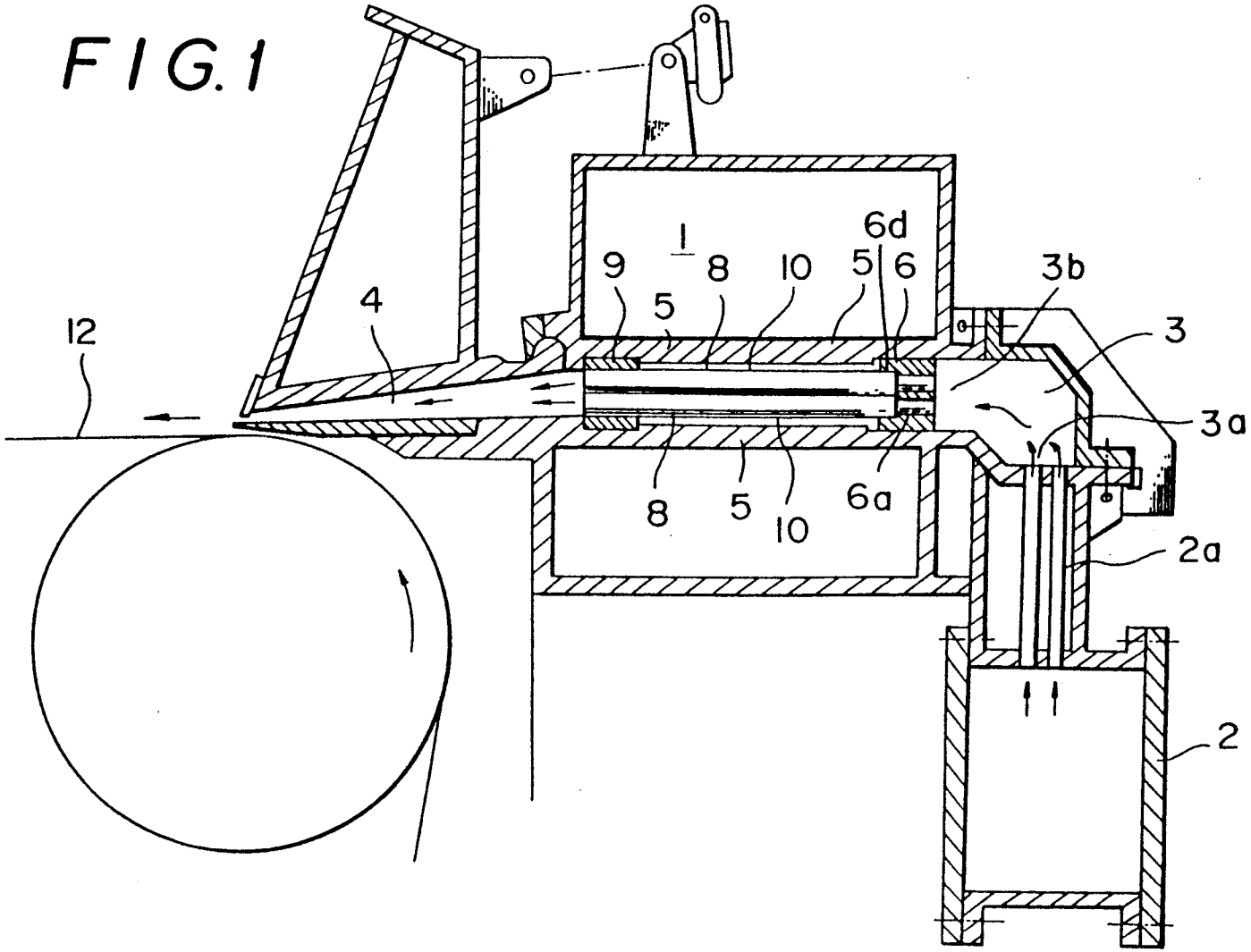
FIG. 1 is a sectional view of a head box in a paper machine according to the present invention.

The embodiment of the present invention will be described with reference to FIGS. 1 through 4.

A head box 1 has a mixing chamber 3 for paper material at a rear end thereof and a slice lip 4, the opening degree of which is adjustable, at a front end thereof. Disposed beneath the mixing chamber 3 a tapered header 2 which is converges in the paper making direction, and the tapered header 2 and the mixing chamber 3 are connected in such a manner as to be communicated with each other through a plurality of manifolds **2*a* arranged in parallel relation in the paper making direction. The manifolds 2*a* extend in the vertical direction and are connected to inlet ports 3*a* formed in a bottom portion of the mixing chamber 3, so that paper material is normally fed into the mixing chamber 3 through the inlet ports 3*a* under pressure. The mixing chamber 3 has a side outlet port 3*b* which opens up toward the slice lip 4. Paper material which has vertically flowed into the mixing chamber 3 from the bottom inlet ports 3*a* horizontally flows out toward the slice lip 4 from the side outlet port 3*b*. Accordingly, the bottom inlet ports 3*a* and the side outlet port 3*b* are arranged a right angle relation. A perforated plate 6 having a number of conduction pores 6*a* is disposed at the outlet port 3*b* of the mixing chamber 3, the perforated plate 6 being non-fixed relative to a frame 5. The conduction pores 6*a*** are circular and arranged in a plurality of rows in the paper making direction as shown in FIGS. 3 and 4.

Furthermore, a plurality of conduction pipes 8 extending in parallel relation toward the slice lip 4 are disposed at the outlet port side of the perforated plate 6. The conduction pipes 8 are formed of elongated regular square-shaped metallic pipes having equal bore diameters along the entire lengths thereof. Also, the conduction pipes 8 are formed of metallic pipes having larger bore diameters than the perforated plate 6. By combining a number of such elongated metallic pipes and spot welding them at important places so as to be integrally formed, they are orderly arranged in such a manner as to have the same pattern as the conduction pores 6*a* as shown in FIGS. 3 and 4.

Figure 2:
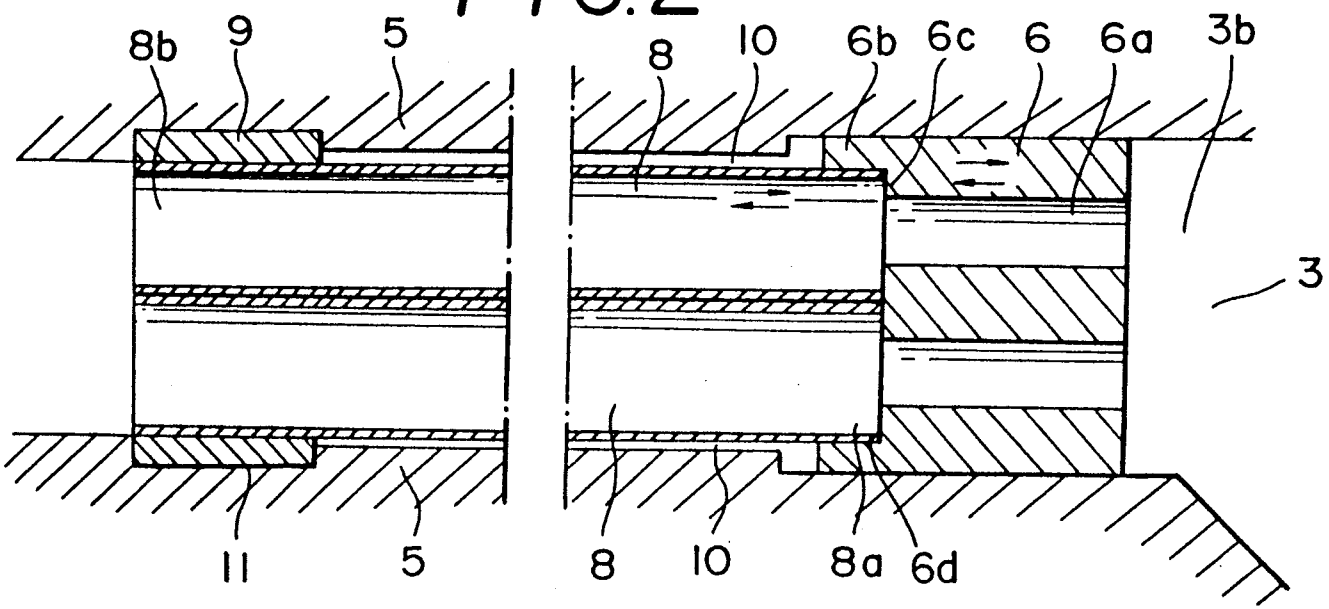
FIG. 2 is a sectional view of a portion of the head box of FIG. 1 where a perforated plate and a group of conduction pipes are disposed.

As described above, the group of the conduction pipes 8 are disposed to extend from the outlet ports 6*a* of the perforated plate 6 to the vicinity of the slice lip 4, first end portions 8*b* on the side of the slice lip 4 being unmovably fixed to the frame 5 for accommodating the conduction pipes. The conduction pipes 8, starting from the fixed ends 8*b*, end at the end portions 8*a* on the side of the perforated plate 6, and are unfixed thereat relative to the frame 5 so as to be able to expand and contract under heat, the non-fixed ends 8*a* being integrally connected to the non-fixed perforated plate 6. Due to the foregoing arrangement, the group of conduction pipes are not expanded and contracted by heat toward the side of the slice lip 4, but are freely expanded and contracted in the direction as shown by an arrow in the drawing toward the side of the mixing chamber 3, the perforated plate 6 being moved following thereto. As a means for integrally connecting the group of conduction pipes 8 to the perforated plate 6, a flange 6*b* is formed on the perforated plate 6 in such a manner as to project from a peripheral edge portion of the front surface of the perforated plate 6, the non-fixed ends 8*a* of the group of conduction pipes 8 being tightly and intimately inserted into an engaging port 6*d* defined by the flange 6*b*, the end faces of the group of conduction pipes 8 being abutted with a front surface (seat surface of the engaging port 6*d*) of the perforated plate 6 and welded to the flange portion 6*b* so that both of them are integrally formed. Due to the foregoing arrangement, the group of conduction pipes 8 are able to integrally expand and contract with the perforated plate 6 on the side of the non-fixed ends. The arrows of FIG. 2 show the heat expanding and contracting directions.

Figure 4:
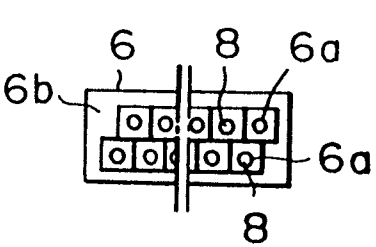
FIG. 4 is a front view showing another example of an arrangement of the group of conduction pipes and conduction pores.
Figure 3:
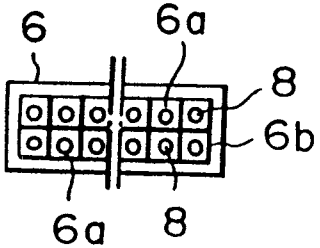
FIG. 3 is a front view showing the arrangement of the group of conduction pipes and conduction pores.

As described above, by connecting the non-fixed ends 8*a* of the group of conduction pipes 8 to the perforated plate 6, the axis of the conduction pores 6*a* and that of the conduction pipes 8 are brought to be in aligned relation with each other, as shown in FIGS. 3 and 4. The paper material passes through the conduction pores 6*a* of the smaller diameters from the mixing chamber 3, then passes through the group of the conduction pipes 8 dispersion and straightening are enhanced therein to give directivity to the flow of the paper material when fed to the slice lip 4. The paper material is flowed onto a paper making belt 12 from a nozzle of the slice lip 4. Also, the outer peripheral surfaces of the end portions 8*b* on the side of the slice lip 4 of the group of conduction pipes 8 are integrally held by a framework 9, and the framework 9 is engaged in a recess portion 11 formed in the frame 5, thereby achieving the above-mentioned unmovable fixed relation.

The group of conduction pipes 8 are positioned at the fixed ends 8*b* by the framework 9 and at the non-fixed ends 8*a* by the flange 6*b*, and enhanced in combination. Also, the group of conduction pipes 8 are horizontally disposed such that the portions between the fixed ends 8*b* and the non-fixed ends 8*a*, in other words the longitudinally disposed portions between the flange 6*b* and the framework 9, are spaced apart from the inner peripheral surface of the frame 5 in order to form a gap 10.

According to the present invention, the group of conduction pipes can be freely expanded and contracted on the side of the non-fixed ends on the side of the perforated plate, and the perforated plate can be integrally moved following the thermal expansion and contraction to absorb the thermal expansion and contraction.

Accordingly, even if a thermal expansion and contraction phenomenon acts on the group of conduction pipes due to a high temperature paper material, and temperature of the circumstances under which it is used, harmful distortion and deformation can surely be prevented from occurring to the group of conduction pipes, accuracy of the group of conduction pipes can be properly maintained under various conditions of use, a uniform flow of the paper material can be ensured, and dispersing and straightening work can be adequately carried out.

Although one preferred embodiment of the present invention has been described in detail, the present invention is of course not limited to this. Various changes and modifications can be made within the scope of the appended claims.

What is claimed is:

1. A head box in a paper making machine, comprising:

a frame having a front end, a rear end, and an inner peripheral surface;

a mixing chamber at said rear end of said frame, said mixing chamber having an outlet port;

a perforated plate having a plurality of conduction pores therethrough disposed in said outlet port of said mixing chamber;

a slice lip at said front end of said frame; and a plurality of elongated pipes extending between said perforated plate and said slice lip, said elongated pipes at one end thereof being integrally connected to said perforated plate, communicating with respective said conduction pores, and said elongated pipes being fixed relative to said frame at the other end thereof;

wherein said perforated plate is movably freely disposed in said outlet and not fixed relative to said frame, whereby said elongated pipes can thermally expand and contract due to temperature changes; and wherein the portions of said plurality of elongated pipes extending between said ends thereof are spaced from said inner peripheral surface of said frame to form a gap such that said plurality of elongated pipes are free to thermally expand and contract.

2. The head box of claim 1, wherein:

said elongated pipes at said other end thereof have a framework holding said elongated pipes; and said frame has a recess at said other end of said elongated pipes in which said framework is fixed.

3. The head box of claim 1, wherein:

said conduction pores of said perforated plate are circular in cross-section; and said elongated pipes have a square cross-section with equal bore diameters throughout the length thereof.

4. The head box of claim 1, wherein:

said perforated plate has a recess into which said elongated pipes extend and are affixed.

* * * * *